US007294045B1

(12) United States Patent
Brown et al.

(10) Patent No.: US 7,294,045 B1
(45) Date of Patent: Nov. 13, 2007

(54) APPARATUS AND METHOD FOR EDGE PROCESSING OF A GLASS SHEET

(75) Inventors: James William Brown, Painted Post, NY (US); David Francis Castellana, Corning, NY (US); Toshihiko Ono, Fukuroi (JP); Ye Guang Pan, Painted Post, NY (US); Ljerka Ukrainczyk, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 11/593,846

(22) Filed: Nov. 7, 2006

Related U.S. Application Data

(60) Provisional application No. 60/752,858, filed on Dec. 21, 2005.

(51) Int. Cl.
*B24B 1/00* (2006.01)

(52) U.S. Cl. ..... 451/44; 451/57; 451/450; 451/451

(58) Field of Classification Search ..... 451/442, 451/57, 59, 60, 58, 449, 451, 388
See application file for complete search history.

(56) References Cited

U.S. PATENT DOCUMENTS 4,716,686 A * 1/1988 Lisec ..... 451/184
5,868,603 A * 2/1999 Allaire et al. ..... 451/29
6,196,902 B1 3/2001 Gazca-Ortiz et al.
6,428,390 B1 8/2002 Clark et al.
6,461,223 B1 10/2002 Bando
6,602,120 B2 8/2003 Bavelloni
6,604,984 B2 8/2003 Gariglio
6,609,956 B2 8/2003 Margaria
6,676,488 B2 1/2004 Brown et al.
6,685,541 B2 2/2004 Brown et al.
6,796,886 B2 9/2004 Bushell
6,845,635 B2 1/2005 Watanabe et al.
6,860,795 B2 3/2005 Hagan et al.
6,869,341 B2 3/2005 Opfer et al.
6,910,953 B2 6/2005 Allaire et al.
6,911,958 B2 6/2005 Chen et al.
7,001,249 B1 * 2/2006 Pride et al. ..... 451/21
2003/0054736 A1 3/2003 Hagan et al.
2004/0209557 A1 10/2004 Gariglio
2005/0011229 A1 * 1/2005 Lisec ..... 65/182.2
2005/0020193 A1 1/2005 Allaire et al.
2005/0026541 A1 2/2005 Allaire et al.
2005/0090189 A1 4/2005 Brown et al.
2005/0124265 A1 6/2005 Hagan et al.

* cited by examiner

*Primary Examiner*—Dung Van Nguyen
(74) *Attorney, Agent, or Firm*—Kevin M. Able

(57) ABSTRACT

An apparatus for edge processing of a glass sheet, the apparatus including a shroud, a finishing member and a wiping device. The finishing member is substantially enclosed by the shroud. The apparatus uses pressurized air emitted by at least one slot in the wiping device to prevent contaminants resulting from the edge processing from settling on and/or adhering to surfaces of the glass sheet. The wiping device may include a jet of washing fluid directed at the glass sheet to further wash the surfaces and the processed edge of the glass sheet.

20 Claims, 5 Drawing Sheets

APPARATUS AND METHOD FOR EDGE PROCESSING OF A GLASS SHEET

This application claims the benefit of priority under 35 U.S.C. § 119(e) of U.S. Provisional Application Ser. No. 60/752,858 filed on Dec. 21, 2005, which application is incorporated herein by reference in its entirety.

BACKGROUND OF THE INVENTION

1. Field of the Invention

The present invention relates to an apparatus and method for processing an edge of a glass sheet. More particularly, the present invention relates to an apparatus and method for grinding or polishing an edge of a glass sheet that can be used in a flat panel display.

2. Technical Background

Liquid crystal displays (LCDs) are passive flat panel displays which depend upon external sources of light for illumination. They are manufactured as segmented displays or in one of two basic configurations. The substrate needs (other than being transparent and capable of withstanding the chemical conditions to which it is exposed during display processing) of the two matrix types vary. The first type is intrinsic matrix addressed, relying upon the threshold properties of the liquid crystal material. The second is extrinsic matrix or active matrix (AM) addressed, in which an array of diodes, metal-insulator-metal (MIM) devices, or thin film transistors (TFTs) supplies an electronic switch to each pixel. In both cases, two sheets of glass form the structure of the display. The separation between the two sheets is the critical gap dimension, of the order of 5-10 μm. The individual glass substrate sheets are typically less than about 0.7 mm in thickness.

Processing glass sheets that require a high quality surface finish like the ones used in flat panel displays typically involves cutting the glass sheet into a desired shape and then grinding and/or polishing the edges of the cut glass sheet to remove any sharp corners. Grinding and polishing steps may, for example, be carried out on an apparatus known as a double edger or double edging machine. Such double edging machines are known and available from Bando Kiko Co., Ltd., Mitsubishi Heavy Industries, Fukuyama Co., and Glass Machinery Engineering.

During the grinding and polishing of the edges of a glass sheet using a double edging machine, the glass sheet is typically sandwiched between two neoprene or rubber belts. The belts contact both surfaces of the glass sheet and cooperate to hold the glass sheet in place while the edges of the glass sheet are ground or polished by an abrasive grinding wheel. The belts also transport the glass sheet through a feeding section of the machine, a grinding or polishing section of the machine, and an end section of the machine.

This method of gripping, processing and conveying a glass sheet using a double edging machine has several disadvantages. First, the particles generated during edge finishing can be a major source of contamination on the surfaces of the glass sheet. Thus, the glass sheet requires extensive washing and drying at the end of the finishing process to clean and wash off the generated particles. Of course, the additional steps of washing and drying at the end of the finishing process impacts the original cost for the finishing line and increases the cost of manufacturing. Secondly, the particles and chips caught between the belts and the glass sheet can severely damage the surfaces of the glass sheet. Sometimes this damage can be the cause of a break source during subsequent processing steps and result in poor process yields due to a reduced number of selects that can be shipped to a customer.

To address the cleanliness concerns, the surfaces of the glass sheet can be protected by a plastic film to help prevent damage and contamination. But, if the source of contamination can be eliminated or minimized, then the plastic film is not needed and that would reduce the cost and complexity of the finishing process.

U.S. Patent Application US2005/0090189 describes a process and apparatus for grinding and/or polishing the edge of a glass sheet wherein pressurized air is distributed through opposing porous plates to prevent particulate generated by the edge processing from contaminating the glass sheet, thereby eliminating the need for plastic coatings. In spite of this advance however, porous plates are subject to low air flow, limiting the effectiveness of the plates in preventing particulate contamination. Moreover, to obtain an effective seal at low air flow rates, the plates must be relatively wide, thus increasing the amount of glass overhanging the glass support and maintained between the plates. Another drawback is that the air flow coming out of the porous plates is non-directional, which decreases its effectiveness in containing the grinding particles and coolant.

For thin glass sheets, such as are used in LCD display devices, vibration due to excess overhang can result in unacceptably rough processed edges.

Accordingly, there is a need for an apparatus and method that helps prevent particles and other contaminants that are generated during edge finishing from contaminating or damaging the two surfaces of a glass sheet, while providing for clean, chip-free processed edges. Moreover, minimizing the generated particle levels would reduce the load on the washing equipment downstream.

SUMMARY

The fusion downdraw method is capable of producing thin (on the order of less than about 0.7 mm in thickness), pristine sheets of glass ideal for the growing luminous, flat panel display industry. Manufacturing steps downstream of the glass sheet forming operations, such as finishing the edges of the glass sheet, may contaminate the sheet with glass particulate, or other finishing-related debris, generated during the edge processing. It is therefore an important consideration to eliminate such contamination, either by reducing the production of contaminates, or by utilizing effective methods of removing contaminates. Accordingly, embodiments of the present invention provide a method and an apparatus for processing the edges of a sheet of material, preferably a glass material, while renewing and maintaining the pristine nature of the sheet.

Briefly described, embodiments of the method and apparatus, among others, can be implemented as described herein. In one such embodiment, an apparatus for processing (e.g. grinding or polishing) an edge of a sheet of material, such as a sheet of glass, is provided comprising a finishing member for processing the edge of the glass sheet. The glass sheet has a pair of substantially parallel surfaces adjacent the edge. The apparatus further includes a shroud constructed and arranged to substantially surround the finishing member. At least one wiping device is disposed proximate one of the pair of surfaces. The wiping device emits pressurized air from at least one slot to remove contaminants resulting from the processing from the surface of the glass sheet.

The apparatus according to the present invention may incorporate a cooling fluid supply member for directing a flow of cooling fluid at the finishing member and/or the glass sheet. Preferably, the flow of cooling fluid is substantially parallel to the edge of the glass sheet.

The apparatus may include a pair of wiping devices positioned in opposition with a gap δ therebetween such that when the sheet of glass is processed, the wiping devices are disposed adjacent opposite sides of the sheet of material.

In some embodiments, the apparatus may also direct a stream of washing fluid onto the sheet of material. Preferably, the washing fluid impinges on the sheet of glass at an angle of between about 35° and 45°.

A shroud, in conjunction with the wiping device, preferably substantially encloses the finishing member and a portion of the edge of the glass sheet, and aids in preventing coolant, washing fluid and particulate resulting from the processing operation from adhering to the sheet of glass. The shroud may include an exhaust passage, and preferably also a drain passage for collecting and exhausting contaminants away from the apparatus. The exhaust passage may have a vacuum applied to assist in contaminant removal. The shroud may also include openings or ports for equalizing pressure within the shroud.

In another embodiment, an apparatus is provided comprising a finishing member for processing the edge of the glass sheet, the glass sheet having a pair of substantially parallel surfaces adjacent the edge, a shroud constructed and arranged to substantially surround the finishing member, a pair of wiping devices arranged in opposition to allow passage of the glass sheet therebetween, each of which emits pressurized air from at least one slot to remove contaminants resulting from the processing from the surfaces of the glass sheet.

In still another broad aspect of the present invention, processing the edge of the glass sheet having a pair of substantially parallel surfaces adjacent the edge with a finishing member, the finishing member being substantially enclosed within a shroud; and directing a stream of pressurized air from at least one slot against the glass sheet to remove contaminants resulting from the processing from the surfaces of the glass sheet.

The invention will be understood more easily and other objects, characteristics, details and advantages thereof will become more clearly apparent in the course of the following explanatory description, which is given, without in any way implying a limitation, with reference to the attached Figures. It is intended that all such additional systems, methods features and advantages be included within this description, be within the scope of the present invention, and be protected by the accompanying claims.

DETAILED DESCRIPTION

Figure 1:
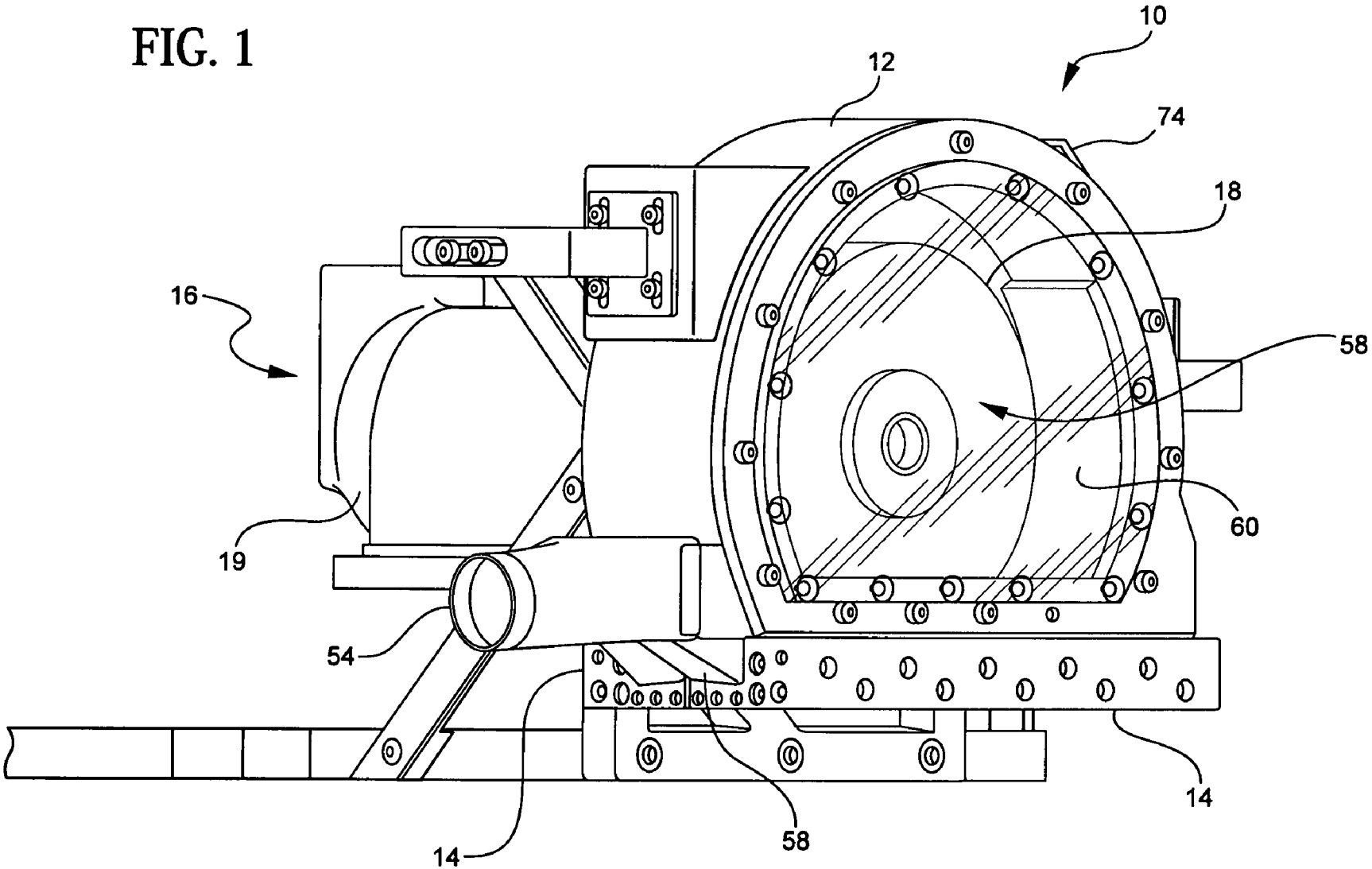
FIG. 1 is a perspective view of an embodiment of an apparatus according to the present invention showing a processing device, a finishing member, a pair of wiping devices and the shroud.

In the following detailed description, for purposes of explanation and not limitation, example embodiments disclosing specific details are set forth to provide a thorough understanding of the present invention. However, it will be apparent to one having ordinary skill in the art, having had the benefit of the present disclosure, that the present invention may be practiced in other embodiments that depart from the specific details disclosed herein. Moreover, descriptions of well-known devices, methods and materials may be omitted so as not to obscure the description of the present invention. Finally, wherever applicable, like reference numerals refer to like elements.

Figures 2, 3:
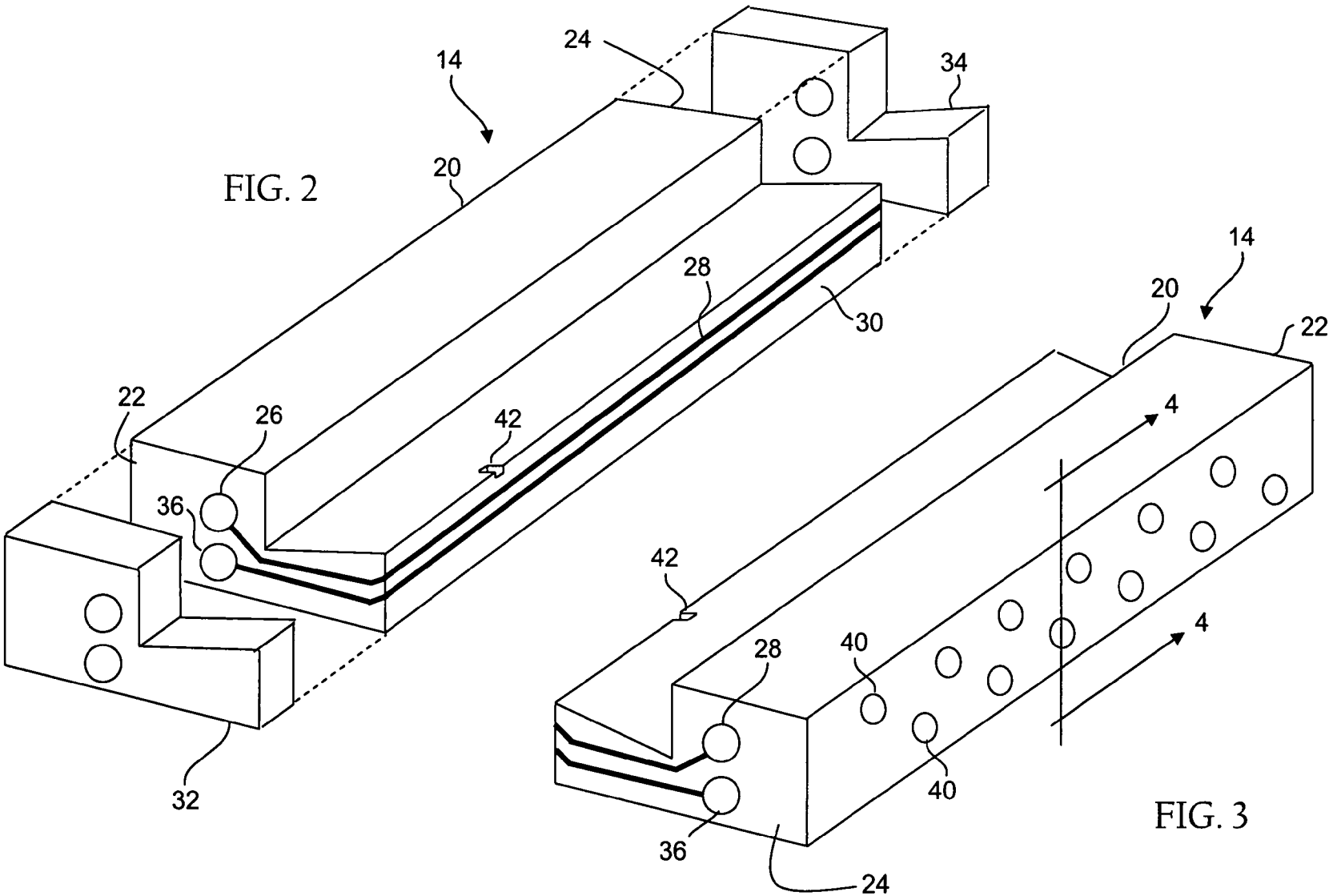
FIG. 2 is an exploded view in perspective of the wiping device of FIG. 1.
FIG. 3 is a perspective view of the wiping device of FIG. 2 seen from the end opposite that shown in FIG. 2, without end caps.

Referring to FIGS. 1-2, there is disclosed in accordance with an exemplary embodiment of the present invention an apparatus 10 for processing an edge of a glass sheet. Although apparatus 10 is described herein as being used to grind or polish an edge of a glass sheet, it should be understood that apparatus 10 can also be used to process other types of materials such as plexi-glass™ or metal. Accordingly, apparatus 10 of the present invention should not be construed in a limited manner.

Apparatus 10 includes shroud 12, at least one wiping device 14, and processing device 16 capable of processing (e.g. grinding or polishing) an edge of the glass sheet. In accordance with the present embodiment, processing device 16 processes a glass sheet via a finishing member 18, such as a grinding wheel, which comprises processing device 16. Processing device 16 may comprise, for example, electric motor 19 for rotating finishing member 18. The at least one wiping device 14 is capable of removing particles and other contaminants, which may be generated when processing device 16 processes an edge of a glass sheet, from a surface of the glass sheet. If only a single side of the glass sheet need be kept clean, one need only use a single wiping device. However, in the instance where both sides of the glass sheet have cleanliness needs, a wiping device may be used on each side of the glass sheet.

In the embodiment illustrated in FIGS. 2-3, wiping device 14 (air knife 14) comprises manifold 20 having first end 22 and second end 24. Manifold 20 further comprises at least one plenum 26 extending longitudinally through manifold 20 between the first and second ends 22, 24. A first slot 28 extends from face 30 into manifold 20 and connects with plenum 26 along a length of plenum 26. First slot 28 preferably also extends longitudinally across face 30. End caps 32 and 34 may be fitted to ends 22 and 24, respectively, such as by bolting the end caps to the ends of manifold 20 to seal the portion of slot 28 at ends 22, 24. Provision is made in either one or both of the end caps for access to plenum 26 so that plenum 26 may be connected to a source of pressurized air (not shown). That is, plenum 26 may be supplied pressurized air from one end or both ends of the plenum. Slot 28 is exposed along the length of face 30 and preferably enters face 30 at an angle relative to face 30.

Manifold 20 may include a second plenum 36, also extending longitudinally through the body between first and second ends 22, 24. If a second plenum is included, second slot 38 extends from face 30 to second plenum 36 in a manner similar to slot 28. The present embodiment will hereinafter be described assuming two plenums and two slots. However, one skilled in the art will recognize that fewer, or more, slots and/or plenums are within the scope of the present invention.

Wiping device 14 may further comprise port 42 for directing a jet of washing fluid onto a glass sheet being processed. Port 42 is connected to a supply of washing fluid (not shown), such as through passages internal to manifold 20, and is supplied under pressure to port 42. However, port 42 could easily comprise a conduit separate from manifold 20. For example, a tube for supplying the washing fluid could be position proximate manifold 20 to provide a stream of washing fluid to the glass sheet. Preferably port 42 is inward from either end 22 or end 24 such that slot 28 extends at least about 5 cm beyond port 42 to improve the removal of water droplets via the pressurized air issuing from the slots and ensure complete drying of the glass sheet. The washing fluid is preferably filtered, and may be deionized water to prevent, for example, mineral residue from forming on the glass sheet. The washing fluid may contain chemical washing agents if desired.

Both first plenum 26 and second plenum 36 may also be connected to a pressurized air source through ends 22, 24 (end caps 32, 34). Alternatively, the plenums may be connected to pressurized air only through passages 40, or both ends 22, 24 and passages 40 (shown in FIG. 3). A plurality of passages 40 may extend from an external surface of manifold 20 to each plenum, and provide for pressurized air to be injected into plenums 26, 36 individually, if desired, along the length of each plenum. Thus, control of the air pressure within each plenum can be controlled as a function of position along the length of each plenum. For example, in some instances, such as when a washing fluid is supplied, it may be desirable to supply pressurized air to each plenum at different pressures along the length of the plenum, such as by varying the supply pressure across the plurality of passages 40, which results in the velocity of the air emitted by the slot to vary along a length of the slot. It has been determined that a high exit velocity for the air exiting each slot proximate a cleaning passage may cause unnecessary "splashing" of the washing fluid, with the potential for wetting portions of the glass sheet interior to the edge of the sheet. In such a case, it may be desirable to supply a lower air pressure to portions of the plenum so that the air emitted by the slot in the vicinity of the washing fluid exits the slot at a lower velocity than air at other locations along the length of the slot.

Figure 4:
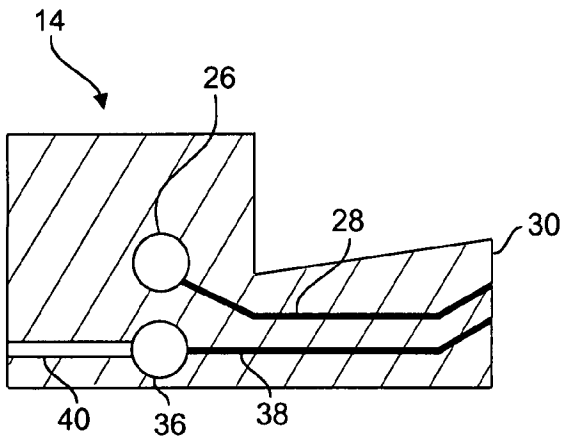
FIG. 4 is a cross sectional view of the wiping device of FIG. 2.

FIG. 4 is a cross sectional end view of wiping device 14 further showing the relationship between each plenum and, for plenum 36, the relationship between a plenum and a passage 40. That is, FIG. 4 illustrates that slots 28, 38 extend from face 30 to plenums 26, 36, respectively, and, in the cross sectional slice shown in FIG. 4, a passage 40 leads from an outside surface of manifold 20 to plenum 36. As passages 40 are shown staggered in FIG. 3, only a single passage 40 connecting to a plenum is shown. As shown in the embodiment of FIG. 1 and discussed briefly above, apparatus 10 may comprise two wiping devices 14 to provide for removing contaminants from both surfaces of the glass sheet. The arrangement of the pair of wiping devices is better illustrated with the aid of FIG. 5.

Figure 5:
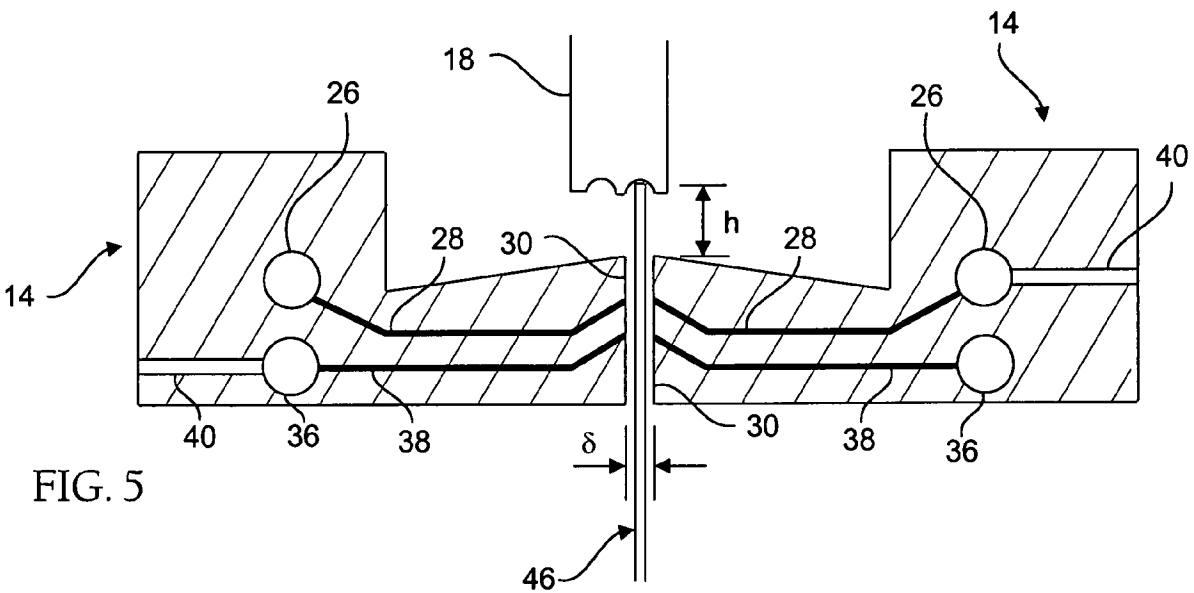
FIG. 5 is a cross sectional side view of a pair of wiping devices arranged in opposition to create gap δ through which a glass sheet may be passed.

FIG. 5 is a cross sectional end view of two wiping devices 14 arranged in opposition to each other and on opposite sides of glass sheet 46. Preferably, the two faces 30 are parallel and separated by gap $\delta$. Gap $\delta$ depends upon the thickness of a glass sheet disposed between the two faces. For display applications, the glass sheet is typically less than about 1 mm thick, and more typically less than about 0.7 mm thick. Preferably, $\delta$ is between about 2 and 5 mm. Glass sheet 46 is supported vertically between the two wiping device faces 30 and extends upward beyond the faces a distance h. Preferably, h is less than about 2.5 cm; more preferably less than about 2 cm; and most preferably between about 1 cm and 2 cm. Glass sheet 46 may be supported by a conventional vacuum chuck, or glass sheet 46 may be supported by using 2-sided water bearings with glass sheet 46 in a vertical or, if apparatus 10 is oriented as such, in a horizontal position. The water bearings can be used in combination with a vacuum bar if desired. In 2-sided water bearing design, the shroud beneficially prevents grinding debris from entering between the water bearings and the glass surface, risking scratching the glass surface. The support device supports glass sheet 12, and may be used to translate glass sheet 12 relative to finishing member 18. For example, the support device may be mounted on rails or tracks, and moved by a linear motor (e.g. stepper motor). Other methods of providing relative motion between the glass sheet and the processing device as are known in the pertinent art may be employed. Movement of the glass sheet is preferably automated, and typically controlled via a computer control system (not shown). Although shown in a vertical configuration, apparatus 10, and glass sheet 46, can be arranged in other orientations, such as horizontal for example.

Figure 6:
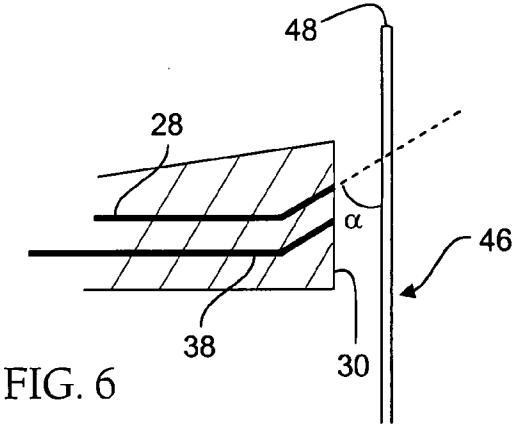
FIG. 6 is a partial cross sectional view of the wiping device showing the angle at which the pressurized air impinges on the glass sheet.

FIG. 6 is a close up view of a face 30 and slots 28, 38 for a single wiping device 14 and shows the relationship between the slots and glass sheet 46. Each wiping device 14 is preferably mounted such that the longitudinal axis of each slot as it opens into face 30 forms an angle $\alpha$ with a plane parallel to a surface of the glass sheet. That is, the air issuing from the slot should impinge on the surface of glass sheet 46 substantially at angle $\alpha$. By substantially what is meant is that the air will undergo some diffusion in direction after leaving the slots, but the general direction of the air flow at the surface of face 30 is at angle $\alpha$. In a typical arrangement, face 30 is parallel with the plane of the glass sheet and passages 26, 28 each form an angle $\alpha$ with the plane of the sheet. However, in the instance where face 30 is not parallel with the plane of the sheet, it need only be that the air emitted from the slots impinges on the sheet at angle $\alpha$. Preferably, the air emitted from each slot impinges on the glass sheet at an angle $\alpha$ of at least about 25° relative to the adjacent surface of glass sheet 46; more preferably between about 25° and 90°; and most preferably between about 35° and 45°. Similarly, the jet of washing fluid, if used, should form an angle with the plane of glass sheet 46 of between about 35° and 45°. The direction of air exiting each slot, and the washing fluid exiting port 42, is toward edge 48 of the glass sheet, into shroud 12 and away from the body of the sheet, thereby limiting contamination of the sheet inward from the wiping device. Those portions of the surface of glass sheet 46 adjacent edge 48 are also washed and dried.

Figure 7:
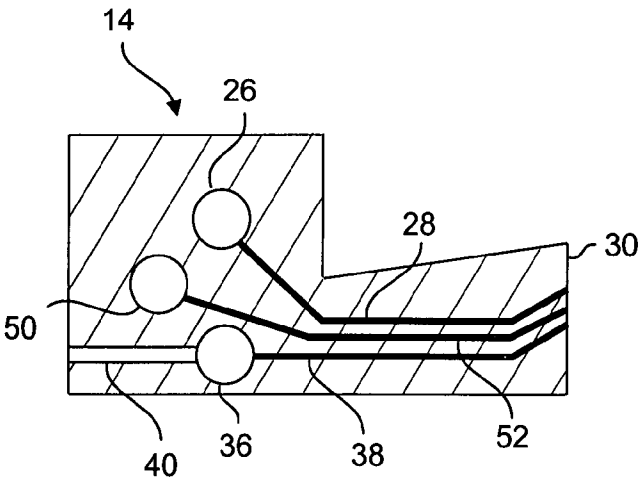
FIG. 7 is a cross sectional view of the wiping device of FIG. 1 which includes a third plenum and slot set to which a vacuum may be applied.

Each wiping device 14 may further include other slots, such as for supplying a vacuum proximate the glass sheet. FIG. 7 illustrates a cross sectional view of wiping device 14 comprising two plenums 26, 36 connected to two slots 28, 38 for directing pressurized air at the surface of glass sheet 46, and a third plenum 50 in fluid communication with slot 52 disposed between slots 28 and 38. Slot 52 preferably extends along the length of manifold 20 from end 22 to end 24. A vacuum is applied to plenum 50, and thereby slot 52, to further improve the cleanliness of the glass sheet by removing particulate from the glass sheet which was not removed, or prevented from being deposited, by the pressurized air emitted by slots 28 and 38.

As described, wiping devices 14 are supplied with pressurized air which exits faces 30 through slots 28, 38. The resulting high pressure and the airflow that is created in the small gap δ between the pair of wiping device faces and against the substantially parallel surfaces of glass sheet 46 deflects and rejects glass and abrasive particles and other contaminants (e.g. washing and cooling fluids) resulting from the finishing of glass sheet edge 48 from reaching the interior surfaces of the sheet. Particulate generated during the processing of edge 48, and washing fluid emitted by ports 42, is directed into shroud 12.

When apparatus 10 is in a vertical orientation, as depicted in FIG. 1, it is preferable that shroud 12 be substantially closed. By substantially closed what is meant is that the shroud box is closed on all sides, but includes various openings for drain passages, cooling fluid ingress, and contact between the finishing member within the shroud box and the glass sheet which extends between the wiping devices. Shroud 12 may therefore comprise exhaust passage 54 in fluid communication with shroud interior 56, and at least one drain passage 58 connected between the exhaust port and the shroud interior. The at least one drain passage 58 assists in collecting particulate and liquids from the shroud interior and directing it to the exhaust passage. In a vertical orientation of apparatus 10, a vacuum may be applied to exhaust passage 54 to assist in removing particulate and washing fluid from the interior of the shroud. Shroud cover 60 assists in closing shroud 12 and reducing the number of openings. If apparatus 10 is in a horizontal orientation, cover 60 may be removed, thereby allowing fluid and particulate to be collected through the resulting opening at what becomes the bottom of the shroud.

Figure 9:
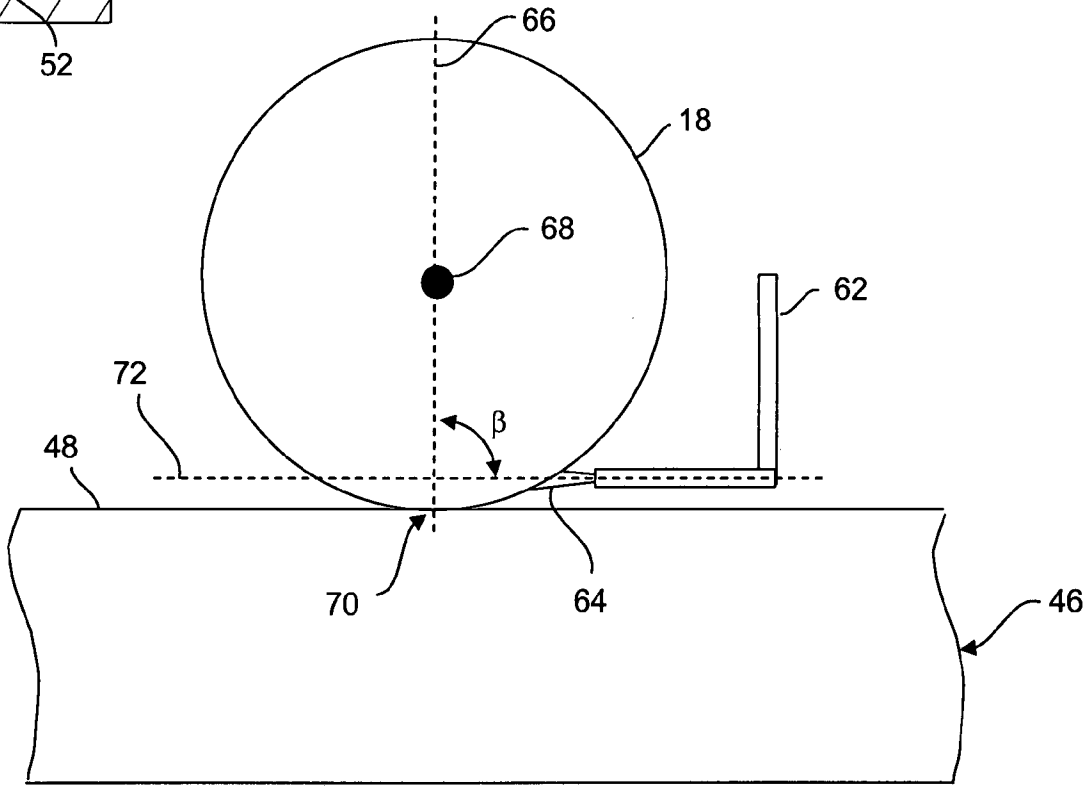
FIG. 9 is a schematic view of the cooling fluid supply member of FIG. 8 showing the geometric relationship of the supply member to the finishing member and the glass sheet.
Figure 8:
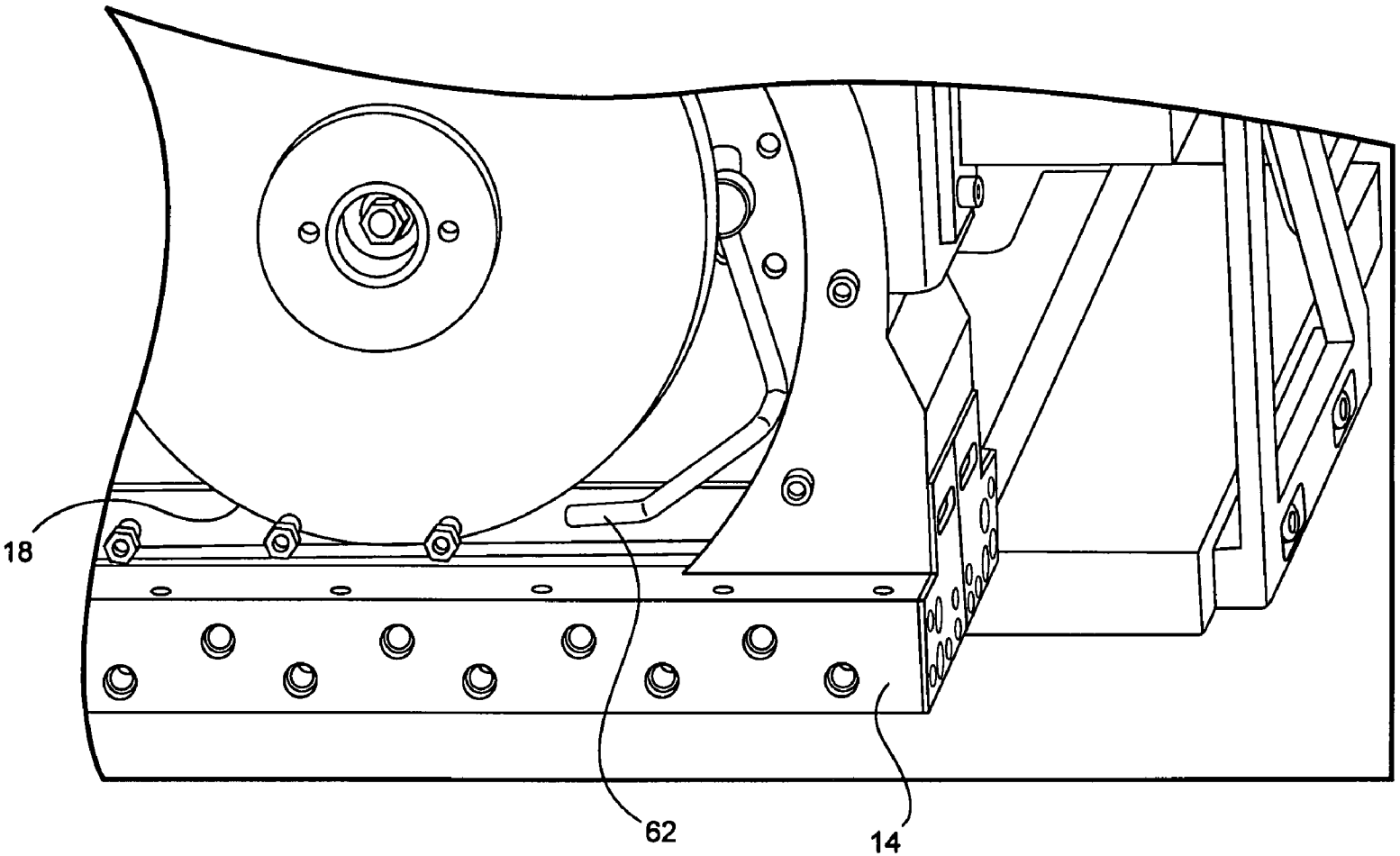
FIG. 8 is a partial perspective view of the apparatus of FIG. 1 showing the cooling fluid supply member.

Referring now to FIGS. 8-9, cooling fluid supply member 62 for lubricating and cooling the contact surface between glass edge 48 and finishing member 18, and, to a lesser degree, removing particulate from the area proximate the contact surface, may be inserted into shroud box 12. Cooling fluid supply member 62 is in fluid communication with a source (not shown) of cooling fluid, typically water, which is delivered to cooling fluid supply member 62 under pressure. It has been found that delivery of the cooling fluid to finishing member 18 preferably occurs such that the stream of cooling fluid 64 emitted by cooling fluid supply member 62 is approximately parallel with edge 48 of glass sheet 46 (parallel to a tangent at the point of contact between the finishing member and the glass sheet), resulting in drier glass adjacent edge 48. That is, angle β between the stream of cooling fluid and the line drawn through the axis of rotation 68 of finishing member 18 and the point 70 where finishing member 18 contacts edge 48 as depicted in FIG. 9 is preferably about 90°. This alignment is preferable because the stream of cooling fluid 64 that is directed approximately parallel to the glass edge (e.g. along line 72) is more likely to be directed by the spinning finishing member back into shroud 12 where it can be removed by exhaust passage 54. If the stream of cooling fluid were to be directed in a direction toward the glass edge, for example, the spinning finishing member is more likely to cause the stream to be directed through the curtain of air emitted by the air knives and onto the glass sheet. Ideally, the stream of cooling fluid 64 is directed at point 70 representing contact between the finishing member and edge 48 of the glass sheet. However, as a practical matter, the edge of the glass sheet may represent an obstacle to cooling fluid supply member 62, thus cooling fluid supply member 62 is generally directed instead to a point on the finishing member slightly ahead of contact point 70 (relative to the direction of rotation of the finishing member) while maintaining the aforementioned parallel relationship between the stream of fluid and the glass edge (e.g. parallel with line 72). In some embodiments, additional cooling fluid supply members may be utilized. In this instance, a first cooling fluid supply member may be located above the glass sheet while a second cooling fluid supply member is located below the glass sheet.

Shroud 12 preferably further includes at least one pressure equalization opening 74 having a cover (not shown) operable between a closed position and an open position which may be used to ensure the environment within the shroud is at a negative pressure relative to ambient pressure outside the shroud box. A negative pressure within the shroud box facilitates a flow of materials (e.g. washing fluid, glass particulate, etc.) into the shroud box from the edge of the glass sheet being processed. It has been found that a rapidly rotating finishing member 18, such as a grinding wheel, in conjunction with exhaust passage 54, serves to create a positive pressure within the shroud box. This effect, believed to be due to a Venturi effect caused by high water flow velocity between airflow generated by the rotating finishing member and the open exhaust passage, is exacerbated by the addition of the coolant and/or washing fluid. Opening of pressure equalization opening 74 can help to alleviate this problem.

It should be emphasized that the above-described embodiments of the present invention, particularly any "preferred" embodiments, are merely possible examples of implementations, merely set forth for a clear understanding of the principles of the invention. Many variations and modifications may be made to the above-described embodiments of the invention without departing substantially from the spirit and principles of the invention. For example, although the example embodiments illustrated herein are shown in a vertical configuration, the present invention can be equally effective in a horizontal orientation. All such modifications and variations are intended to be included herein within the scope of this disclosure and the present invention and protected by the following claims.

What is claimed is:

1. An apparatus for processing an edge of a sheet of glass, the apparatus comprising:

a finishing member for processing the edge of a glass sheet having a pair of substantially parallel surfaces adjacent the edge;

a shroud adapted to substantially surround the finishing member;

at least one wiping device disposed proximate one of the pair of surfaces; and wherein the at least one wiping device emits pressurized air from a slot in the wiping device to remove contaminants resulting from the processing from the surfaces of the glass sheet.

2. The apparatus according to claim 1 wherein the at least one wiping device comprises a pair of wiping devices disposed proximate opposite surfaces of the glass sheet.

3. The apparatus according to claim 1 wherein the at least one wiping device emits a jet of washing fluid which impinges on the glass sheet.

4. The apparatus according to claim 3 wherein the washing fluid impinges on the glass sheet at an angle of between about 35° and 45° relative to a plane of the glass sheet.

5. The apparatus according to claim 1 wherein the pressurized air exits the slot at an angle $\alpha$ between about 25° and 90° relative to a plane of the glass sheet.

6. The apparatus according to claim 1 wherein the finishing member is capable of grinding or polishing the edge of the glass sheet.

7. The apparatus according to claim 1 wherein the wiping device comprises a plurality of slots for emitting pressurized air.

8. The apparatus according to claim 1 further comprising a cooling fluid supply member for directing a flow of cooling fluid at the finishing member proximate a point of contact between the finishing member and the glass sheet, the flow of cooling fluid being substantially parallel to the edge of the glass sheet.

9. The apparatus according to claim 1 wherein the wiping device further comprises a vacuum slot to which a vacuum is applied.

10. The apparatus according to claim 1 wherein the shroud further includes an exhaust passage in fluid communication with an interior of the shroud for removing contaminants therefrom.

11. The apparatus according to claim 1 wherein a velocity of the pressurized air emitted by the slot varies along a length of the slot.

12. An apparatus for processing an edge of a sheet of glass, the apparatus comprising:

a finishing member for processing the edge of the glass sheet, the glass sheet having a pair of substantially parallel surfaces adjacent the edge;

a shroud constructed and arranged to substantially surround the finishing member;

a pair of wiping devices arranged in opposition with a gap between the wiping devices to allow passage of the glass sheet therebetween; and wherein each wiping device emits pressurized air from at least one slot in the wiping device to remove particles generated when the finishing member processes the edge of the glass sheet.

13. The apparatus according to claim 12 further comprising an exhaust passage in fluid communication with an interior of the shroud, the exhaust passage having a vacuum applied thereto.

14. The apparatus according to claim 12 wherein each wiping device comprises a port for directing a jet of washing fluid at the glass sheet.

15. A method for processing an edge of a sheet of glass, the method comprising:

processing the edge of the glass sheet having a pair of substantially parallel surfaces adjacent the edge with a finishing member, the finishing member being substantially enclosed within a shroud; and directing a stream of pressurized air from at least one slot against the glass sheet to remove contaminants resulting from the processing from the surfaces of the glass sheet.

16. The method according to claim 15 wherein the pressurized air is directed against the glass sheet from a plurality of slots.

17. The method according to claim 15 further comprising removing contaminants from the glass sheet via a vacuum slot.

18. The method according to claim 15 further comprising directing a stream of washing fluid at the edge simultaneously with the directing a stream of pressurized air.

19. The method according to claim 15 further comprising directing a stream of cooling fluid at the finishing member.

20. The method according to claim 19 wherein the stream of cooling fluid is substantially parallel with the edge.

* * * * *